US008516999B2

(12) United States Patent
Sasaki

(10) Patent No.: US 8,516,999 B2
(45) Date of Patent: Aug. 27, 2013

(54) GAS FUEL INJECTION CONTROL DEVICE OF ENGINE FOR VEHICLE

(75) Inventor: Takamitsu Sasaki, Shizuoka (JP)

(73) Assignee: Suzuki Motor Corporation, Shizuoka (JP)

( * ) Notice: Subject to any disclaimer, the term of this patent is extended or adjusted under 35 U.S.C. 154(b) by 300 days.

(21) Appl. No.: 13/019,454

(22) Filed: Feb. 2, 2011

(65) Prior Publication Data

US 2011/0186013 A1 Aug. 4, 2011

(30) Foreign Application Priority Data

Feb. 4, 2010 (JP) ..... 2010-023273

(51) Int. Cl.
*F02M 69/04* (2006.01)

(52) U.S. Cl.
USPC ..... 123/527

(58) Field of Classification Search
USPC ..... 123/399, 403, 436, 445, 478–480, 123/486, 491–494, 525, 527–529, 575–579, 123/675, 681–684; 701/101–106, 110, 113–115
See application file for complete search history.

(56) References Cited

U.S. PATENT DOCUMENTS

| | | | | |
|---|---|---|---|---|
| 3,651,794 | A * | 3/1972 | Douglas | 123/332 |
| 5,357,656 | A * | 10/1994 | Trowbridge | 24/370 |
| 5,588,416 | A * | 12/1996 | Suzuki et al. | 123/684 |
| 5,611,316 | A | 3/1997 | Oshima et al. | |
| 5,771,857 | A | 6/1998 | Willi | |
| 6,816,773 | B2 * | 11/2004 | Tafazoli et al. | 701/103 |
| 7,463,967 | B2 * | 12/2008 | Ancimer et al. | 701/104 |
| 2007/0157909 | A1 * | 7/2007 | Tokunaga | 123/527 |
| 2009/0088950 | A1 * | 4/2009 | Fisher et al. | 701/103 |

FOREIGN PATENT DOCUMENTS

| | | | |
|---|---|---|---|
| JP | 62-13766 | A | 1/1987 |
| JP | 05164002 | A * | 6/1993 |
| JP | 7-189811 | A | 7/1995 |
| JP | 09250369 | A * | 9/1997 |
| JP | 2005083248 | A * | 3/2005 |
| JP | 2005140040 | A * | 6/2005 |

OTHER PUBLICATIONS

German Office Action, dated Apr. 29, 2013, which issued during the prosecution of German Patent Application No. 102011000290.1, which corresponds to the present application.

* cited by examiner

*Primary Examiner* — Stephen K Cronin
*Assistant Examiner* — John Zaleskas
(74) *Attorney, Agent, or Firm* — Troutman Sanders LLP

(57) ABSTRACT

A control unit sets a transition determination filter value determining a transition operation state of an engine, and calculates a transition determination intake pipe internal pressure from the transition determination filter value, a previously detected intake pipe internal pressure, and a currently detected intake pipe internal pressure. When the time after the start of the engine exceeds a predetermined value, the unit calculates a transition determination intake pipe internal differential pressure from the currently detected intake pipe internal pressure and the transition determination intake pipe internal pressure. Setting an intake pipe internal pressure filtering value based on the transition determination intake pipe internal differential pressure, and calculating an intake pipe internal pressure used for gas fuel injection control this time from the intake pipe internal pressure filtering value, the currently detected intake pipe internal pressure, and an intake pipe internal pressure previously used for gas fuel injection control.

3 Claims, 4 Drawing Sheets

GAS FUEL INJECTION CONTROL DEVICE OF ENGINE FOR VEHICLE

CROSS-REFERENCE TO RELATED APPLICATIONS

This application is based upon and claims the benefit of priority of the prior Japanese Patent Application No. 2010-023273, filed on Feb. 4, 2010, the entire contents of which are incorporated herein by reference.

BACKGROUND OF THE INVENTION

1. Field of the Invention

The present invention relates to a gas fuel injection control device of an internal combustion engine for vehicle, and more specifically to a gas fuel injection control device of an engine for vehicle in which the accuracy of a calculating method of an intake pipe internal pressure for use in an injection quantity control of a gas fuel in a constant-speed operation and transition operation states such as acceleration and deceleration operation states of the engine.

2. Description of the Related Art

A gas fuel injection control device of an engine for vehicle that is supplied with a gas fuel such as CNG (compressed natural gas) reduces the pressure of the gas fuel supplied from a fuel container using a regulator and injects the gas fuel, which has been reduced in pressure to a set pressure, from a fuel injection valve. The regulator operates so that the intake pipe internal pressure introduced from a surge tank part of an intake manifold via a hose and the gas pressure upstream of the fuel injection valve are constant. The gas fuel injection control device detects the intake pipe internal pressure and the gas pressure upstream of the fuel injection valve and controls the fuel injection time according to a pressure correction coefficient that is inversely proportional to the differential pressure between them.

[Patent Document 1] Japanese Laid-open Patent Publication No. 7-189811

[Patent Document 2] Japanese Laid-open Patent Publication No. 62-13766

Incidentally, the gas fuel injection control device of an engine for vehicle in the related art performs the same filtering in the processing of the intake pipe internal pressure value irrespective of the engine in the constant-speed operation state or in the transition operation state, and therefore has following problems.

One of the problems is that, in the constant-speed operation, there is not a large difference between the differential pressure detected by the gas fuel injection control device between the intake pipe internal pressure and the gas pressure upstream of the fuel injection valve and the differential pressure in the regulator, whereas at the abrupt acceleration operation or the abrupt deceleration operation, a difference occurs between the differential pressure detected by the gas fuel injection control device and the differential pressure in the regulator because of a response delay of the regulator, resulting in failure to appropriately calculate the pressure correction coefficient.

Performing the filtering of the intake pipe internal pressure in consideration of the response delay of the regulator at the transition operation as measures causes another problem of failing to detect the pulsation of the intake pipe internal pressure and the gas pressure at the constant-speed operation, resulting in failure to appropriately calculate the pressure correction coefficient.

Another problem is that because the same filtering is performed at the constant-speed operation and the transition operation, it is impossible to appropriately correct either the pressure correction at the constant-speed operation or the pressure correction at the transition operation, causing excess or deficiency of the fuel injection quantity and affecting the operation of the engine.

SUMMARY OF THE INVENTION

An object of the invention is to improve the accuracy of gas fuel injection control by accurately correcting an intake pipe internal pressure which greatly affects the correction of the injection quantity of gas fuel injected from a fuel injection valve.

The present invention is a gas fuel injection control device of an engine for vehicle including an intake pipe internal pressure detection unit detecting a pressure inside an intake pipe based on a predetermined control cycle and a gas pressure detection unit detecting a pressure of a gas fuel upstream of a fuel injection valve, for correcting and controlling an injection quantity of the gas fuel based on a differential pressure obtained from the detected intake pipe internal pressure and gas pressure, the gas fuel injection control device including: a control unit performing control to previously set a transition determination filter value for determining a transition operation state of the engine, and calculate a transition determination intake pipe internal pressure from the transition determination filter value, an intake pipe internal pressure that was detected last time, and an intake pipe internal pressure that has been detected this time, and when a lapse time after start of the engine exceeds a predetermined value, calculate a transition determination intake pipe internal differential pressure from the intake pipe internal pressure that has been detected this time and the transition determination intake pipe internal pressure, set an intake pipe internal pressure filtering value based on the transition determination intake pipe internal differential pressure, and calculate an intake pipe internal pressure that is used for gas fuel injection control this time from the intake pipe internal pressure filtering value, the intake pipe internal pressure that has been detected this time, and an intake pipe internal pressure that was used for gas fuel injection control last time.

DETAILED DESCRIPTION OF THE PREFERRED EMBODIMENTS

Hereinafter, an embodiment of the invention will be described based on the drawings.

Embodiment

Figure 1A:
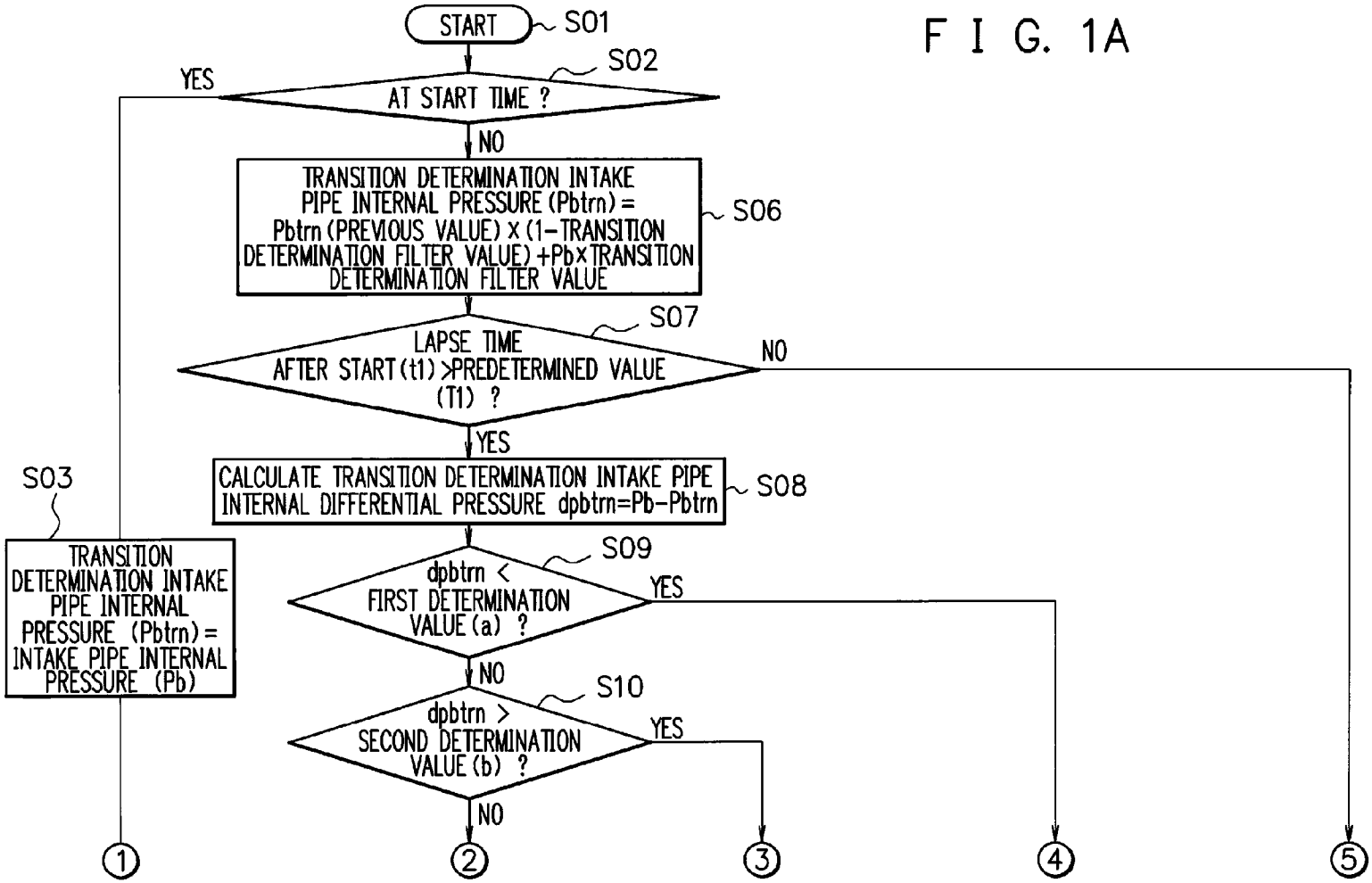
FIG. 1A is a control flowchart of a gas fuel injection control device (embodiment)
Figure 1B:
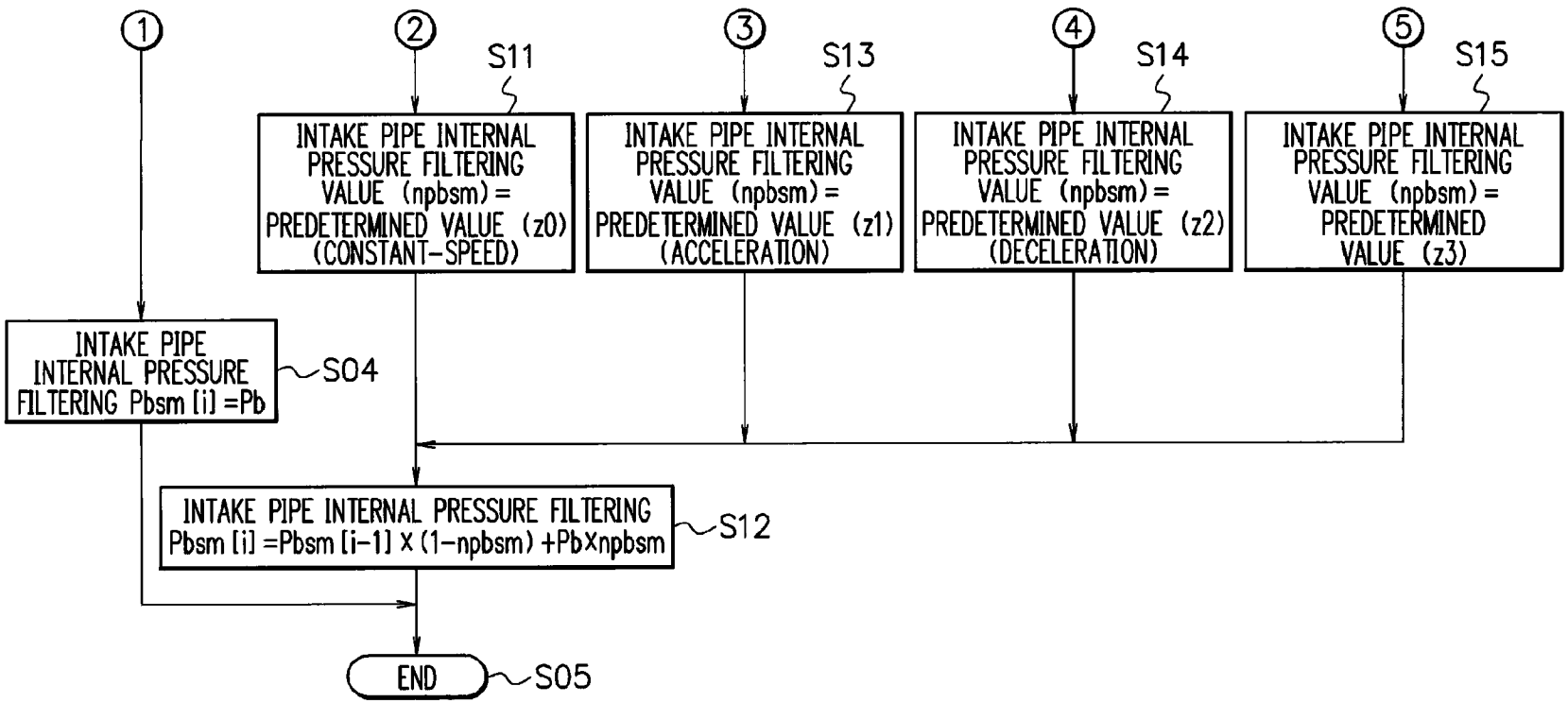
FIG. 1B is a control flowchart of a gas fuel injection control device (embodiment)
Figure 2:
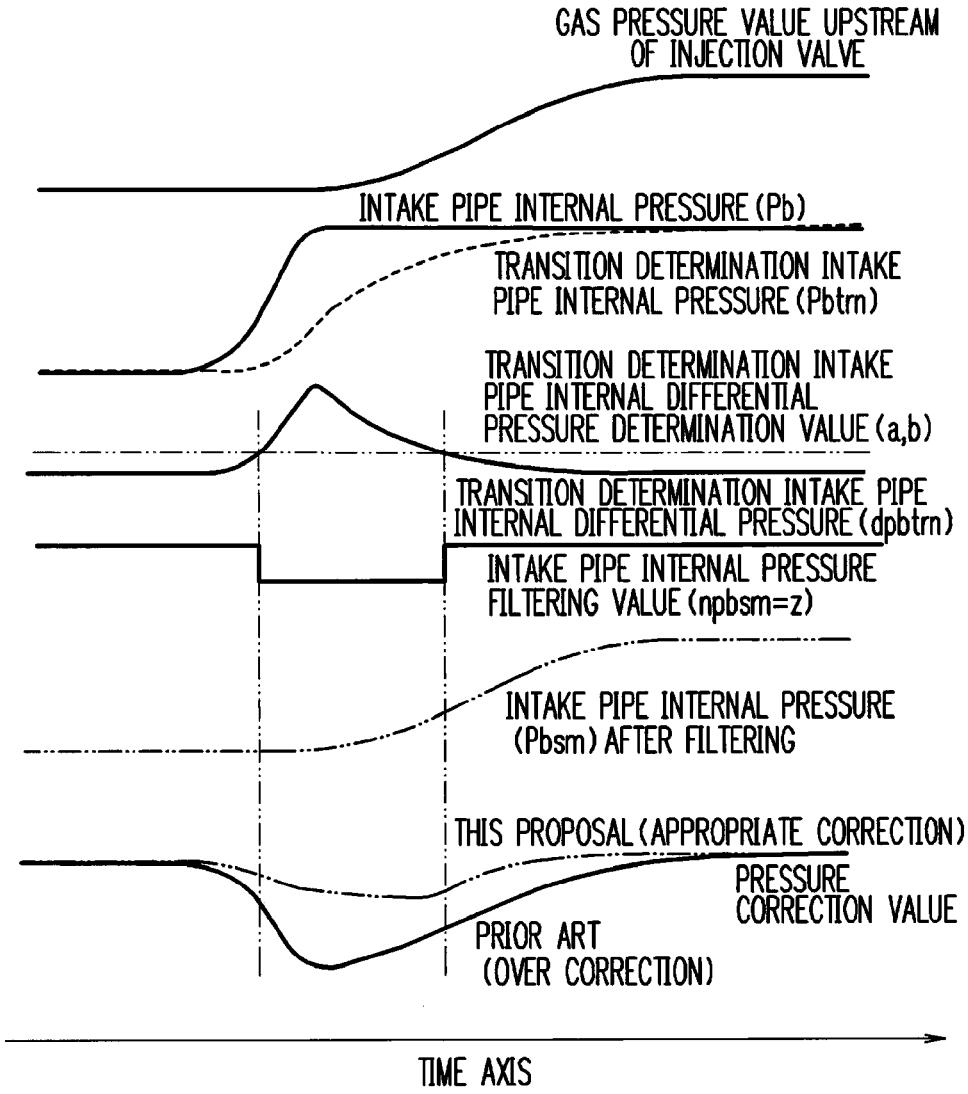
FIG. 2 is a control time chart of the gas fuel injection control device (embodiment)
Figure 3:
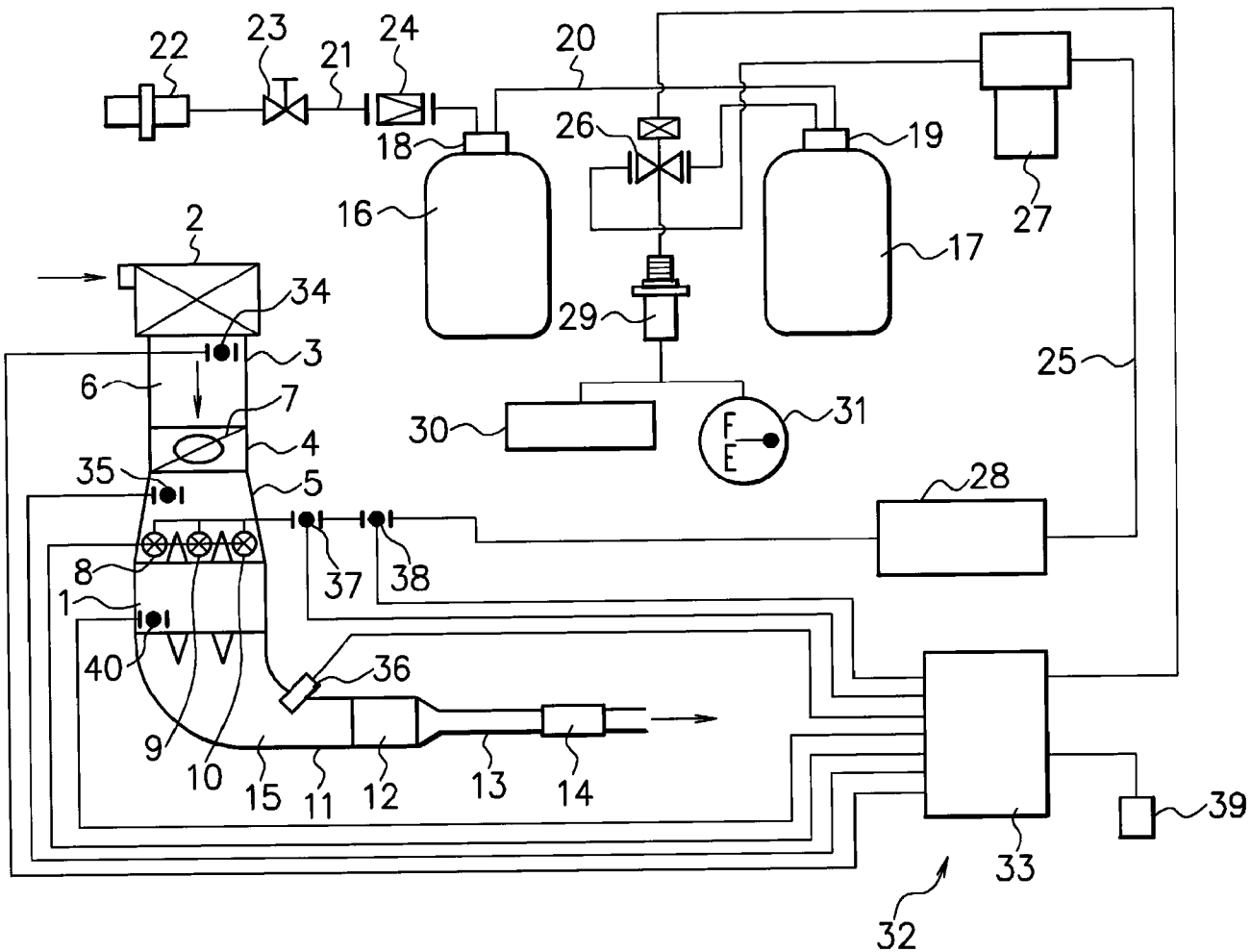
FIG. 3 is a system configuration diagram of the gas fuel injection control device (embodiment).

FIG. 1A to FIG. 3 illustrate the embodiment of the invention. In FIG. 3, numeral 1 denotes an engine for vehicle (hereinafter, described as an "engine"). The engine 1 has, for example, three cylinders and includes, as an intake system, an air cleaner 2, an intake pipe 3, a throttle body 4, and an intake manifold 5 and thereby communicates an intake passage 6 with the cylinders. In the intake passage 6 of the throttle body 4, a throttle valve 7 is provided. A first fuel injection valve 8 to a third fuel injection valve 10 corresponding to the respective cylinders are attached to the intake manifold 5. Further, the engine 1 includes, as an exhaust system, an exhaust manifold 11, a three-way catalyst 12, an exhaust pipe 13, and a muffler 14 and thereby communicates an exhaust passage 15 with the cylinders.

The engine 1 is supplied with a gas fuel stored in two fuel containers such as a first fuel container 16 and a second fuel container 17. The first and second fuel containers 16, 17 include a first container master valve 18 and a second container master valve 19 respectively and are communicated with each other via a fill communicating pipe 20. To the first fuel container 16, one end side of a fuel fill pipe 21 is connected. At the other end side of the fuel fill pipe 21, a fill port 22 for the gas fuel is provided. Along the fuel fill pipe 21, a fuel fill valve 23 which fills the gas fuel into the first and second fuel containers 16, 17 and a check valve 24 which prevents the gas fuel from reversely flowing from the first and second fuel containers 16, 17 side to the fill port 22 side, are provided in sequence from the fill port 22 side toward the first fuel container 16.

To the second fuel container 17, one end side of a fuel supply pipe 25 is connected. The other end side of the fuel supply pipe 25 is connected to the first to third fuel injection Valves 8 to 10 attached to the intake manifold 5. Along the fuel supply pipe 25, a main stop valve 26 which operates to close so as to block the fuel supply pipe 25 when the engine 1 is stopped, a gas filter 27 which filters the gas fuel, and a regulator 28 which reduces the pressure of the gas fuel at a high pressure to regulate the flow rate to constant, are provided in sequence from the second fuel container 17 side toward the first to third fuel injection valves 8 to 10 side.

At the main stop valve 26, a residual pressure sensor 29 is provided as a fuel residual pressure detection unit capable of detecting the fuel residual pressure value. To the residual pressure sensor 29, a digital fuel gauge 30 and an analog fuel residual quantity gauge 31 are communicated.

The first to third fuel injection valves 8 to 10 and the main stop valve 26 are connected to a control unit 33 of a gas fuel injection control device 32. The control unit 33 here is, for example, an ECU (Electronic Control Unit). To the control unit 33 of the gas fuel injection control device 32, an intake temperature sensor 34 as an intake temperature detection unit detecting the temperature of intake air flowing through the intake passage 6 inside the intake pipe 3, an intake pipe internal pressure sensor 35 as an intake pipe internal pressure detection unit detecting the pressure inside the intake manifold 5 communicating with the intake pipe 3 based on a predetermined control cycle, an oxygen sensor 36 as an oxygen concentration detection unit detecting the oxygen concentration in the exhaust flowing through the exhaust passage 15 inside the exhaust manifold 11, a fuel temperature sensor 37 as a fuel temperature detection unit detecting the temperature of the gas fuel in the fuel supply pipe 25 upstream of the first to third fuel injection valves 8 to 10 and between the first to third fuel injection valves 8 to 10 and the regulator 28, a gas pressure sensor 38 as a gas pressure detection unit detecting the pressure of the gas fuel in the fuel supply pipe 25 upstream of the first to third fuel injection valves 8 to 10 and between the first to third fuel injection valves 8 to 10 and the regulator 28, an ignition switch 39 for detecting the start time and the post-start of the engine 1, and a water temperature sensor 40 detecting the engine cooling water temperature, are connected.

In the gas fuel injection control device 32, the control unit 33 corrects and controls the injection quantity of the gas fuel from the first to third fuel injection valves 8 to 10 based on the differential pressure obtained from the intake pipe internal pressure detected by the intake pipe internal pressure sensor 35 and the gas pressure detected by the gas pressure sensor 38.

In the gas fuel injection control device 32, the control unit 33 performs control to previously set a transition determination filter value for determining the transition operation state of the engine 1 and calculate a transition determination intake pipe internal pressure from the transition determination filter value, the intake pipe internal pressure that was detected last time, and the intake pipe internal pressure that has been detected this time, and when a lapse time after start of the engine 1 exceeds a predetermined value, calculate a transition determination intake pipe internal differential pressure from the intake pipe internal pressure that has been detected this time and the transition determination intake pipe internal pressure, set an intake pipe internal pressure filtering value based on the transition determination intake pipe internal differential pressure, and calculate the intake pipe internal pressure that is used for the gas fuel injection control this time from the intake pipe internal pressure filtering value, the intake pipe internal pressure that has been detected this time, and the intake pipe internal pressure that was used for the gas fuel injection control last time.

The control unit 33 compares the transition determination intake pipe internal differential pressure with two predetermined determination values to determine whether the transition operation state of the engine 1 is an acceleration operation state, a constant-speed operation state, or a deceleration operation state, and sets, for the determined operation state, one of three intake pipe internal pressure filtering values which correspond to the acceleration operation state, the constant-speed operation state, and the deceleration operation state and are different from one another.

When the lapse time after start of the engine 1 is not greater than the predetermined value, the control unit 33 sets a fourth intake pipe internal pressure filtering value that is different from the three intake pipe internal pressure filtering values.

Next, control by the gas fuel injection control device 32 will be described based on FIG. 1A, FIG. 1B and FIG. 2.

When control is started (S01) in FIG. 1A, the control unit 33 of the gas fuel injection control device 32 judges whether or not the engine 1 is at start time (S02).

When this judgment is YES (at start time) (S02), the control unit 33 sets the transition determination intake pipe internal pressure Pbtrn to an intake pipe internal pressure Pb that has been detected based on the predetermined control cycle (S03), sets the intake pipe internal pressure Pb as an intake pipe internal pressure Pbsm[i] that is used for control this time (S04), and ends the control (S05).

When the aforesaid judgment (S02) is NO (after start), the control unit 33 obtains the transition determination intake pipe internal pressure Pbtrn from the following Expression (S06)

$$Pbtrn = Pbtrn(\text{previous value})*(1-kNPBTRN) + Pb*kNPBTRN$$

(kNPBTRN: transition determination filter value), and judges whether a lapse time t1 after start of the engine 1 exceeds a predetermined value T1 (S07).

When this judgment (S07) is YES (t1>T1), the control unit 33 obtains the transition determination intake pipe internal differential pressure dpbtrn from the following Expression (S08)

$$dpbtrn=Pb-Pbtrn,$$

and judges whether the transition determination intake pipe internal differential pressure dpbtrn is less than a first determination value a (S09).

When this judgment (S09) is NO (dpbtrn≧a), the control unit 33 judges whether the transition determination intake pipe internal differential pressure dpbtrn exceeds a second determination value b (S10).

When this judgment (S10) is NO (dpbtrn≦b), the control unit 33 sets an intake pipe internal pressure filtering value npbsm to a first intake pipe internal pressure filtering value z0 that corresponds to the constant-speed operation state (S11), performs filtering using the first intake pipe internal pressure filtering value z0 to obtain the intake pipe internal pressure Pbsm[i] that is used for control this time from the following Expression (S12)

$$Pbsm[i]=Pbsm[i-1]*(1-npbsm)+Pb*npbsm(i-1\text{: previous value, } npbsm\text{: } z0),$$

and ends the control (S05).

When this judgment (S10) is YES (dpbtrn>b), the control unit 33 sets the intake pipe internal pressure filtering value npbsm to a second intake pipe internal pressure filtering value z1 that corresponds to the acceleration operation state (S13), performs filtering using the second intake pipe internal pressure filtering value z1 to obtain the intake pipe internal pressure Pbsm[i] that is used for control this time from the following Expression (S12)

$$Pbsm[i]=Pbsm[i-1]*(1-npbsm)+Pb*npbsm(i-1\text{: previous value, } npbsm\text{: } z1),$$

and ends the control (S05).

When the aforesaid judgment (S09) is YES (dpbtrn<a), the control unit 33 sets the intake pipe internal pressure filtering value npbsm to a third intake pipe internal pressure filtering value z2 that corresponds to the deceleration operation state (S14), performs filtering using the third intake pipe internal pressure filtering value z2 to obtain the intake pipe internal pressure Pbsm[i] that is used for control this time from the following Expression (S12)

$$Pbsm[i]=Pbsm[i-1]*(1-npbsm)+Pb*npbsm(i-1\text{: previous value, } npbsm\text{: } z2),$$

and ends the control (S05).

On the other hand, when the aforesaid judgment (S07) is NO (t1≦T1), the control unit 33 sets the intake pipe internal pressure filtering value npbsm to a fourth intake pipe internal pressure filtering value z3 that is different from the first to third intake pipe internal pressure filtering values z0 to z2 (S15), performs filtering using the fourth intake pipe internal pressure filtering value z3 to obtain the intake pipe internal pressure Pbsm[i] that is used for control this time from the following Expression (S12)

$$Pbsm[i]=Pbsm[i-1]*(1-npbsm)+Pb*npbsm(i-1\text{: previous value, } npbsm\text{: } z3),$$

and ends the control (S05).

The intake pipe internal pressure Pbsm[i] obtained in each of the aforesaid (S11), (S13) to (S14) is used for controlling the injection quantity of the gas fuel by the first to third fuel injection valves 8 to 10. Note that the predetermined value T1 for determining the lapse time t1 is interpolated by a thwst table based on the engine cooling water temperature at the start time detected by the water temperature sensor 40. Further, the first determination value a, the second determination value b, the second intake pipe internal pressure filtering value z1, and the third intake pipe internal pressure filtering value z2 are interpolated by an ne table. Furthermore, the fourth intake pipe internal pressure filtering value z3 is interpolated by the thwst table based on the engine cooling water temperature at the start time.

Here, in the thwst table for setting T1, it is necessary to set times required to stabilize the start that are characteristic values in respective engines 1. In the thwst table, the time required to stabilize the start is set for each of temperatures divided in arbitrary intervals of temperature. Generally, the time is set longer at a lower temperature. As the stability of the start, it is only necessary to observe, for example, change in load.

Further, any of values found by interpolation calculation from the ne table, namely, the first determination value a, the second determination value b, the second intake pipe internal pressure filtering value z1, and the third intake pipe internal pressure filtering value z2 are less affected by the response delay of the regulator at a higher speed rotation of the engine rotation number, so that the values only need to be set to decrease the filtering execution condition and the filter value for each of engine rotation numbers ne divided in arbitrary intervals of engine rotation number ne.

Specifically, for example, a negative value is set for a number kP in the first determination value a. A positive value is set for a number kP in the second determination value b. For each of them, a numerical value with a larger absolute value is set as the engine rotation number ne increases. Further, for each of the second intake pipe internal pressure filtering value z1 and the third intake pipe internal pressure filtering value z2, a coefficient of 1 or less is set as a dimensionless value. For the second intake pipe internal pressure filtering value z1, a larger numeric value is set as the engine rotation number ne increases. For the third intake pipe internal pressure filtering value z2, a value substantially constant may be set.

Further, the fourth intake pipe internal pressure filtering value z3 found by the interpolation calculation from the thwst table is set in consideration of desired startability in the start by the gas fuel, and a coefficient of 1 or less only needs to be set as a dimensionless value. Specifically, for example, in the case of taking no count of the startability, it is only necessary to set an arbitrary value that is a substantially constant value. In the case of taking account of the startability, it is only necessary to set a lower value for a lower water temperature.

As described above, in the gas fuel injection control device 32, the control unit 33 performs control to previously set the transition determination filter value kNPBTRN for determining the transition operation state of the engine 1 and calculate the transition determination intake pipe internal pressure Pbtrn from the transition determination filter value kNPBTRN, the intake pipe internal pressure Pb that was detected last time, and the intake pipe internal pressure Pb that has been detected this time, and when the lapse time t1 after start of the engine 1 exceeds the predetermined value T1, calculate the transition determination intake pipe internal differential pressure dpbtrn from the intake pipe internal pressure Pb[i] that has been detected this time and the transition determination intake pipe internal pressure Pbtrn, set the intake pipe internal pressure filtering value npbsm based on the transition determination intake pipe internal differential pressure dpbtrn, and calculate the intake pipe internal pressure Pbsm[i] that is used for the gas fuel injection control this time from the intake pipe internal pressure filtering value npbsm, the intake pipe internal pressure Pb that has been detected this time, and the intake pipe internal pressure Pbsm [i−1] that was used for the gas fuel injection control last time.

Thus, the gas fuel injection control device 32 judges the operation state at present by calculating the transition determination intake pipe internal pressure Pbtrn and then calculating the transition determination intake pipe internal differential pressure dpbtrn and thereby appropriately performs the filtering thereafter, and therefore can perform appropriate correction without over-correction as in the related art as shown in FIG. 2 and improve the accuracy of the fuel injection control by the intake pipe internal pressure Pbsm based on the appropriate filtering.

Further, the gas fuel injection control device 32 subdivides the operation state after the operation of the engine 1 becomes stable, and thereby becomes possible to perform more appropriate filtering and contribute to improvement in accuracy.

The control unit 33 of the gas fuel injection control device 32 compares the transition determination intake pipe internal differential pressure dpbtrn with two predetermined determination values a, b (a<b) to determine whether the transition operation state of the engine 1 is the acceleration operation state, the constant-speed operation state, or the deceleration operation state, and sets, for the determined operation state, one of the first to third intake pipe internal pressure filtering values z0 to z2 as the three intake pipe internal pressure filtering values npbsm which correspond to the acceleration operation state, the constant-speed operation state, and the deceleration operation state and are different from one another.

Thus, the gas fuel injection control device 32 divides the transition operation state of the engine 1 into the acceleration operation state, the constant-speed operation state, or the deceleration operation state which are different from one another in responsibility and thereby becomes possible to perform more appropriate filtering. The gas fuel injection control device 32 can improve the control accuracy of the fuel injection by the intake pipe internal pressure Pbsm based on the appropriate filtering.

Further, when the lapse time t1 after start of the engine 1 is not greater than the predetermined value T1, the control unit 33 of the gas fuel injection control device 32 sets, as the intake pipe internal pressure filtering value npbsm, the fourth intake pipe internal pressure filtering value z3 that is different from the three, first to third intake pipe internal pressure filtering values z0 to z2.

Thus, the gas fuel injection control device 32 subdivides the intake pipe internal pressure filtering value npbsm before and after the operation state of the engine 1 becomes stable, and thereby becomes possible to perform more appropriate filtering in the respective cases. The gas fuel injection control device 32 can improve the control accuracy of the fuel injection by the intake pipe internal pressure Pbsm based on the appropriate filtering.

The present invention improves the accuracy of fuel injection control by accurately correcting the intake pipe internal pressure used in gas fuel injection control of a fuel injection valve, and is applicable to an engine for vehicle supplied with gas fuel such as CNG (compressed natural gas).

The gas fuel injection control device of an engine for vehicle of the invention judges the operation state at present by calculating the transition determination intake pipe internal pressure and then calculating the transition determination intake pipe internal differential pressure and thereby appropriately performs the filtering thereafter, and therefore can improve the accuracy of the gas fuel injection control by the intake pipe internal pressure based on the appropriate filtering.

Further, the gas fuel injection control device of an engine for vehicle of the invention subdivides the operation state after the operation of the engine becomes stable, and thereby becomes possible to perform more appropriate filtering and contribute to improvement in accuracy.

The present embodiments are to be considered in all respects as illustrative and no restrictive, and all changes which come within the meaning and range of equivalency of the claims are therefore intended to be embraced therein. The invention may be embodied in other specific forms without departing from the spirit or essential characteristics thereof.

What is claimed is:

1. A gas fuel injection control device of an engine for a vehicle comprising an intake pipe internal pressure detection unit detecting a pressure inside an intake pipe based on a predetermined control cycle and a gas pressure detection unit detecting a pressure of a gas fuel upstream of a fuel injection valve, for correcting and controlling an injection quantity of the gas fuel based on a differential pressure obtained from the detected intake pipe internal pressure and the gas pressure, said gas fuel injection control device comprising: a control unit performing control to previously set a transition determination filter value for determining a transition operation state of the engine, and calculate a transition determination intake pipe internal pressure from the transition determination filter value, an intake pipe internal pressure that was detected last time, and an intake pipe internal pressure that has been detected this time, and when a lapse time after start of the engine exceeds a predetermined value, calculate a transition determination intake pipe internal differential pressure from the intake pipe internal pressure that has been detected this time and the transition determination intake pipe internal pressure, set an intake pipe internal pressure filtering value based on the transition determination intake pipe internal differential pressure, and calculate an intake pipe internal pressure that is used for gas fuel injection control this time from the intake pipe internal pressure filtering value, the intake pipe internal pressure that has been detected this time, and an intake pipe internal pressure that was used for gas fuel injection control last time.

2. The gas fuel injection control device of an engine for a vehicle according to claim 1, wherein said control unit compares the transition determination intake pipe internal differential pressure with two predetermined determination values to determine whether the transition operation state of the engine is an acceleration operation state, a constant-speed operation state, or a deceleration operation state, and sets, for the determined operation state, one of three intake pipe internal pressure filtering values which correspond to the acceleration operation state, the constant-speed operation state, and the deceleration operation state and are different from one another.

3. The gas fuel injection control device of an engine for a vehicle according to claim 2, wherein when the lapse time after start of the engine is not greater than the predetermined value, said control unit sets a fourth intake pipe internal pressure filtering value that is different from the three intake pipe internal pressure filtering values.

* * * * *